United States Patent [19]

Lang

[11] 4,034,148

[45] July 5, 1977

[54] TWISTED PAIR MULTI-CONDUCTOR RIBBON CABLE WITH INTERMITTENT STRAIGHT SECTIONS

[75] Inventor: Donald D. Lang, Garden Grove, Calif.

[73] Assignee: Spectra-Strip Corporation, Garden Grove, Calif.

[22] Filed: Jan. 30, 1975

[21] Appl. No.: 545,582

[52] U.S. Cl. ..... 174/34; 174/117 F

[51] Int. Cl.[2] ..... H01B 7/08; H01B 11/04

[58] Field of Search ..... 174/27, 34, 72 R, 72 C, 174/72 TR, 72 A, 70 C, 117 R, 117 F, 117 FF

[56] References Cited

UNITED STATES PATENTS

| | | | |
|---|---|---|---|
| 2,144,872 | 1/1939 | Cruser | 174/117 F |
| 3,733,428 | 5/1973 | Fry | 174/117 F X |
| 3,736,366 | 5/1973 | Wittenberg | 174/117 F X |
| 3,764,727 | 10/1973 | Balde | 174/117 FF |
| 3,775,552 | 11/1973 | Schumacher | 174/117 F |
| 3,819,848 | 6/1974 | Fry | 174/117 F |

FOREIGN PATENTS OR APPLICATIONS

| | | | |
|---|---|---|---|
| 429,660 | 2/1948 | Italy | 174/117 F |
| 854,700 | 11/1960 | United Kingdom | 174/34 |

*Primary Examiner*—Arthur T. Grimley
*Attorney, Agent, or Firm*—I. Morley Drucker

[57] ABSTRACT

This invention relates to a multi-conductor cable, which comprises a plurality of insulated wire conductor pairs, each of said insulated conductor pairs having alternating twisted portions and straight portions, and alignment means for aligning said insulated conductor pairs in a predetermined spaced relationship with respect to each other. Immediately adjacent twisted portions of each conductor pair are twisted in counter-rotation to each other, and a straight portion of conductor pairs between the said adjacent twisted portions is thereby achieved.

The alignment means of the multi-conductor cable of this invention comprises a laminated plastic film, initially formed from first and second plastic films, the laminated film having a. a plurality of spaced encapsulating ducts formed therein, each encapsulating duct containing at least one of said insulated conductor pairs and preventing untwisting of each of the insulated conductor pairs contained therein and b. nip areas extending laterally between, and joining, each of said spaced encapsulating ducts.

The intermittent straight portions provide easy termination sites and do not appreciably affect the electrical characteristics of the multi-conductor cable.

11 Claims, 9 Drawing Figures

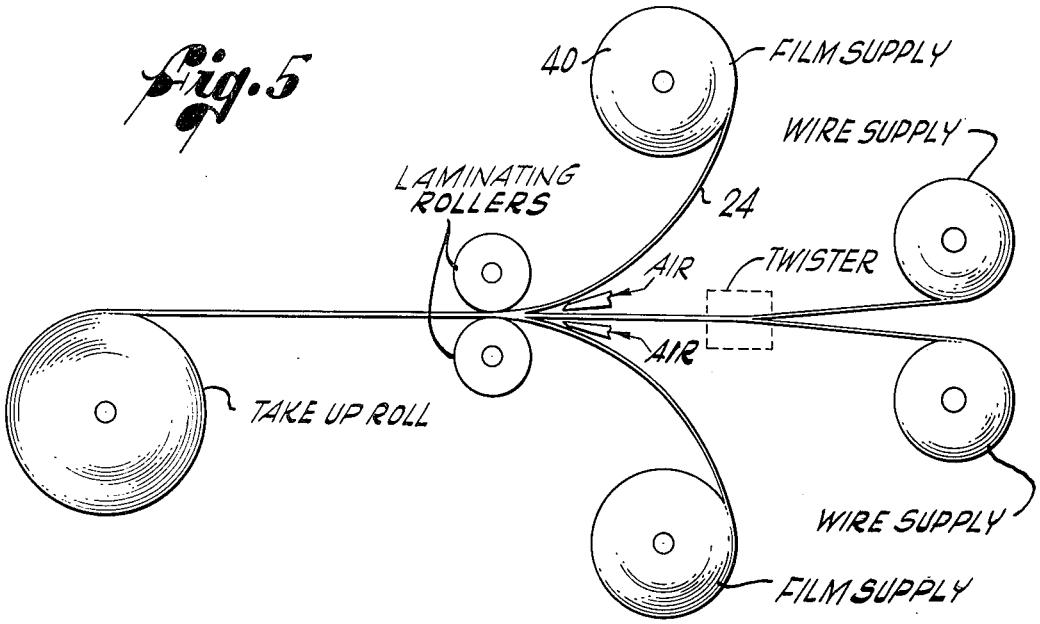
Fig. 5
40
FILM SUPPLY
WIRE SUPPLY
LAMINATING ROLLERS
24
AIR
TWISTER
AIR
TAKE UP ROLL
WIRE SUPPLY
FILM SUPPLY
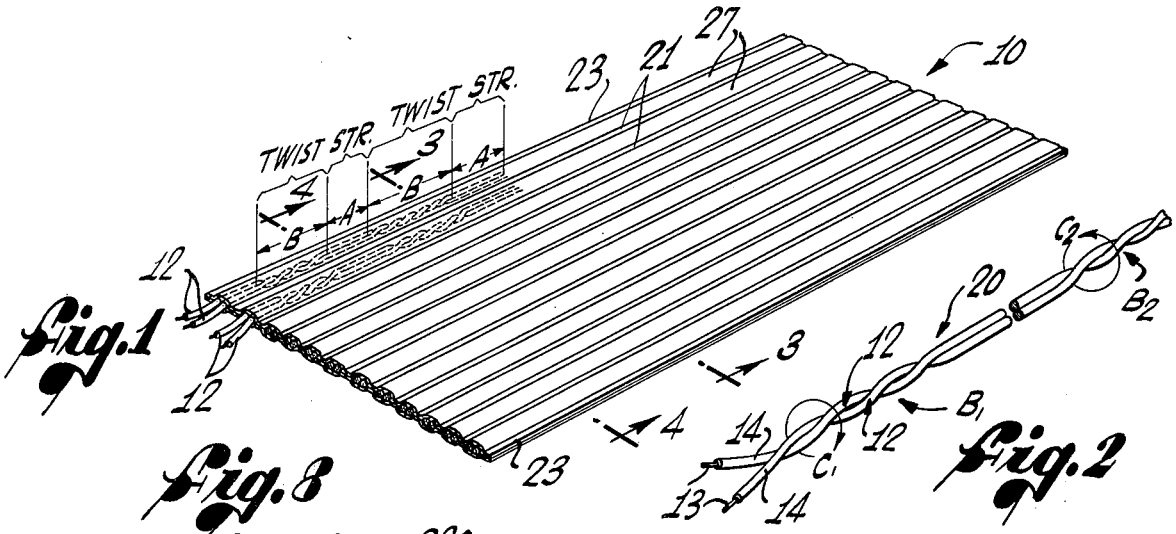
Fig. 1
TWIST STR.
TWIST STR.
27
23
21
10
12
12
23
3
4
A
B
C2
B2
20
12
B1
C1
14
13
14
Fig. 2
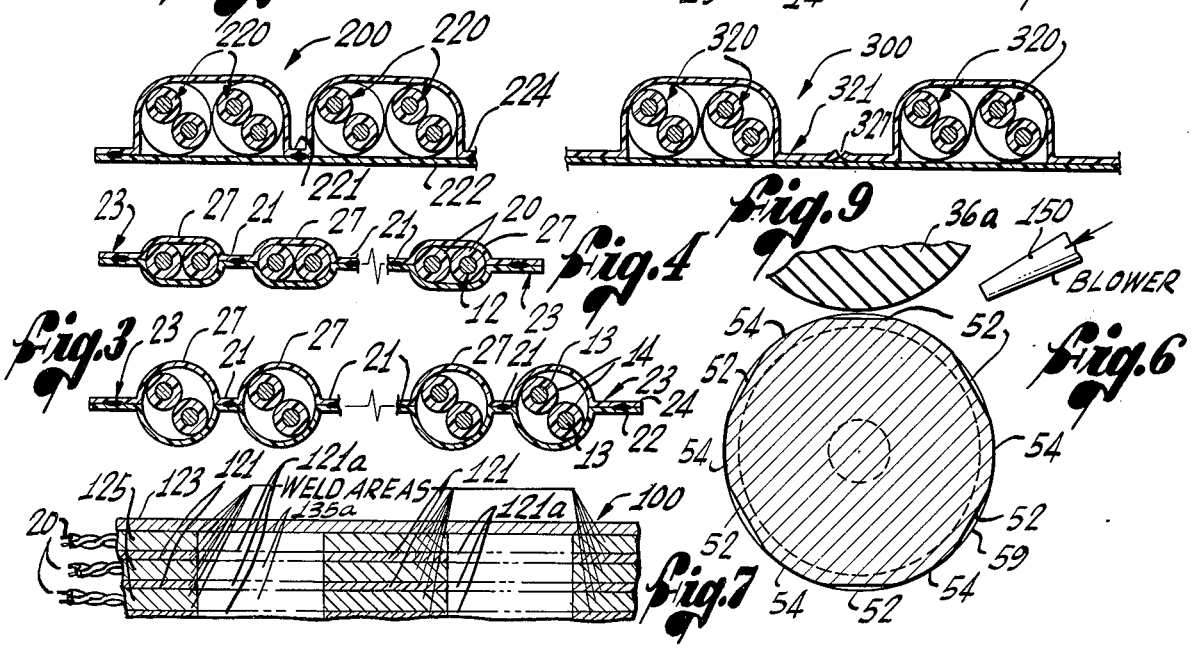
Fig. 8
220
200
220
224
221
222
Fig. 9
320
300
320
321
321
Fig. 4
23
27
21
20
12
Fig. 3
13
14
22
24
Fig. 6
36a
150
BLOWER
52
54
59
Fig. 7
125
123
121
121a
WELD AREAS
135a
100
20

TWISTED PAIR MULTI-CONDUCTOR RIBBON CABLE WITH INTERMITTENT STRAIGHT SECTIONS

BACKGROUND OF THE INVENTION

It has become increasingly important to accurately space the insulated multiple conductors with respect to each other and laminated flat ribbon cable has increasingly come into use for this purpose. Precise control of electrical characteristics such as impedance, capacitance, cross talk and attenuation, especially important in digital data, and signal, transmission is thereby achieved. Both controlled regular spacing and controlled irregular spacing, of multiple conductors in ribbon cable form has been achieved, in the prior art, by laminating the accurately spaced insulated (or uninsulated multiple conductors between thin plastic film, such as 5 mil polyvinyl chloride (pvc) film or 5 mil Teflon* film.

*Teflon is a registered trademark of E. I duPont de Nemours, Wilmington, Del.

Multiple pairs of insulated wires have also been accurately spaced, in ribbon cable, by laminating multiple pairs of twisted wire between thin plastic film, the twisted pairs being first laid onto a lower plastic film and encapsulated and accurately oriented by an upper plastic film laminated to the lower film. The use of twisted pairs of multi-conductor cable is of great importance in the field of communications, data processing and other applications where cross-talk in signal transmission must be kept to a minimum. The laminated, twisted pair, multi-conductor ribbon cable of the prior art has, however, one material drawback, namely, that present, standard, terminating techniques require that after the twisted pairs which are to be terminated have been separated from the laminate, the ends of each pair must then be untwisted manually, or with the aid of a special pliers or other tools. The separation procedure is time consuming and becomes impractical when dealing with large amounts of termination points or when it may be preferred to terminate the ends of such multi-conductor laminated ribbon cable onto an Insulation Displacement Connector (IDC), for an IDC requires great accuracy in the spacing of the ends of the multi-conductor cable which are to be terminated thereon.

The invention is therefore directed towards an improved laminated multi-conductor ribbon cable, having a plurality of twisted pairs of cables laminated therein, which overcomes the just-mentioned time-consuming problem of untwisting the cable for termination purposes.

SUMMARY OF THE INVENTION

This invention is directed to a laminated, multi-conductor ribbon cable which is made of a first laminating plastic film on which is placed a plurality of pairs of insulated conductors, each of said pairs of insulated conductors having alternating twisted portions and straight portions, and a second laminating plastic film which encapsulated and orients the plurality of insulated conductor pairs along a predetermined spacing.

The first and second plastic films are preferably heat welded or heat sealed under pressure, to each other, on either side of the conductors, and the films may also be heat welded to the insulation of the conductor themselves in order to precisely anchor and space the conductor pairs, with respect to adjacent conductor pairs.

The conductor pairs are separated from each other, where desired, by simply slitting the nip or "bite" areas, i.e., those areas where the upper and lower laminating films are welded to each other. The nip areas are slit preferably to a point in the straight area of the conductor pair so that when that separated conductor pair is to be terminated it can be done without untwisting the pairs.

Each insulated conductor pair in the multi-conductor ribbon cable of this invention is preferably formed in a manner such that immediately adjacent twisted portions of each conductor pair are twisted in counter-rotation to each other and a straight portion of conductor pairs between the adjacent, counter-rotated twisted portions is thereby achieved. The number of twists, per inch, and the length of the straight portions, can be readily and accurately controlled. The twisting of the conductor pairs takes place in a processing line a fraction of a second prior to the laminating step - so that the laminating film encapsulates the conductor pairs and prevents any tendency of the conductor pairs to untwist.

The resulting multi-conductor ribbon cable of this invention is probably best briefly described, as one which comprises a. a plurality of insulated wire conductor pairs, each of said insulated conductor pairs having alternating twisting portions and straight portions; and
b. alignment means for aligning said insulated conductor pairs in a predetermined spaced relationship with respect to each other.

Immediately adjacent twisted sections of each conductor pair are preferably twisted in counter-rotation to each other. The alignment means preferably comprises a laminated plastic film having a plurality of spaced encapsulating ducts formed therein, each encapsulating duct containing at least one of said insulated conductor pairs and preventing untwisting of the conductor pair(s) contained therein, and nip areas extending laterally between, and joining, each of said spaced encapsulating ducts.

This invention also is directed to the combination of the twist/straight laminated multi-conductor ribbon cable, just described, with intermittent bonding of the upper and lower films along the length of the cable. Thus, in the ribbon cable of this invention, the welding of the plastic films in the nip areas and/or to the insulation of the conductors may be continuous along the length of the insulated conductor pairs but in the combination including the intermittent bonding, the welding of the laminated films to each other and/or the welding of the plastic film to the insulation of the conductor pairs is intermittent in regular patterns of sealed and unsealed portions.

Unsealed portions of the laminated films are preferably aligned with straight portions of the twisted/-straight conductor pairs so that when a conductor pair is to be terminated, it can be not only easily separated in the straight portions thereof but the encapsulating films offer no resistance to separation because they are not sealed to the insulation of the straight portions of the conductor pairs.

BRIEF DESCRIPTION OF THE DRAWINGS

FIG. 1 is a perspective view of a portion of a first embodiment of the laminated, multi-conductor, twist and straight ribbon cable of this invention;

FIG. 2 is a perspective view of a portion of an alternating twist and straight insulated conductor pair, per se, without any laminated film therearound;

FIG. 3 is a fragmentary cross-sectional view of the ribbon cable, taken along the line 3—3 of FIG. 1, the line 3—3 being taken along a twisted portion of the conductor pairs of the cable;

FIG. 4 is a cross-sectional view of the cable taken along the line 4—4 of FIG. 2, the line 4—4 being taken along a straight portion of the conductor pairs of the cable;

FIG. 5 is a schematic view of the process steps for producing the cable of FIGS. 1–4;

FIG. 6 is an enlarged, fragmentary cross-sectional, axial, view of another embodiment of the laminating rollers shown in FIG. 5;

FIG. 7 is a plan view of a second embodiment of the multi-conductor ribbon cable of this invention;

FIG. 8 is a cross-sectional view of a third embodiment of a multi-conductor ribbon cable of this invention; and FIG. 9 is a cross-sectional view of a fourth embodiment of a multi-conductor ribbon cable of this invention.

DETAILED DESCRIPTION OF THE INVENTION

One embodiment of the multi-conductor ribbon cable of this invention is shown in perspective in FIGS. 1–4 and is designated by the numeral 10. The cable 10 comprises a plurality of aligned, spaced pairs of insulated conductors 12, one pair of which is shown in FIG. 2. Each insulated conductor 12, in turn, comprises a central metal conductor, e.g., of copper or aluminum 13 with a preferably round pvc or other plastic insulation 14 formed therearound.

Each pair of conductors 12, 12 is provided with alternating twisted sections B and, preferably shorter straight sections A, as seen in FIG. 1. Twisted pairs of insulated conductors are highy preferred over straight conductor pairs because of the reduction of cross-talk in signal transmission and for other reasons, as previously mentioned.

An insulated conductor pair, having alternating twisted sections B and straight sections A, is designated, generally, by the numeral 20. Straight sections A are, preferably, kept as short as possible, e.g., ¼ to 4 inches in length, and twisted sections A can have any predetermined length depending upon the electrical characteristics. Each insulated conductor 12 of a conductor pair 20 is normally color coded, or otherwise distinctive marked, so as to differentiate it from the other conductor in the conductor pair.

A plurality of the conductor pairs 20 are then spaced on a lower laminating plastic film 22, along a predetermined regular or irregular spacing pattern and encapsulated by means of an upper film of plastic film 24. The plastic films 22 and 24 are preferably made of pvc or Teflon, but many other plastics may also be employed. These plastic films are readily fusable to each other, and to the insulation 14 of the conductors 13, under the influence of heat and pressure.

It is presently preferred that the conductor pairs 20 be made in a manner such that immediately adjacent twisted portions B have the conductors 12 twisted in counter-rotation to each other. The electrical characteristics of the conductor pair of unaffected but, in a high speed continuous process, this form of conductor pair is presently preferred. Thus, referring to FIG. 2, the twisted portion $B_1$ of conductor pair 20 has been twisted, in a clockwise direction, and twisted portion $B_2$ of this conductor pair has been twisted in a counter-clockwise direction, as indicated by the arrows $C_1$ and $C_2$.

More specifically, and referring now to FIG. 5 in particular, a plurality of insulated conductors 12 are conveyed from wire supply rollers 30 (only two of which are shown in FIG. 5) into a twister apparatus 32. The twister apparatus 32 twists each pair of aligned insulated conductors 12 first about the axis of rotation in one direction and then in the reverse direction. There is a very short period of time between cycles of rotation and counter rotation in which the conductor pair 20 is untwisted and therefore remains straight for this period of time. The timing of the cycles of rotation and counter rotation and the timing of the period of time between the cycles of rotation can be variably controlled, or programmed, resulting in a wide, almost infinite, variety of twist and straight sections which constitute the conductor pairs 20. One resulting conductor pair is shown, by way of example only, in FIG. 2.

The plurality of aligned twist and straight conductor pairs 20 are then conveyed through laminating rollers 34, 36 along with lower and upper plastic films 22 and 24, respectively. The lower and upper plastic films 22, 24 are supplied from film supply rollers 38, 40, respectively.

The lower laminating roller 34 is preferably made of aluminum and has multiple grooves formed therein (as indicated by the dotted line 42 shown in FIG. 5), the multiple grooves being spaced along the roller 34 at intervals determined by the particular spacing of conductor pairs 20 desired in the finished cable 10.

The lower plastic film 22 is thin and flexible, and readily conforms to the groove pattern of the roller 34. The grooves 42 are machined to a width that wholly includes the twist and straight portions of the insulated conductor pairs 20, and is of a depth sufficient to include all, or at least a substantial portion of, the conductor pairs. This is best shown in FIG. 4 wherein it can be seen that the depth of the grooves is approximately one-half of the diameter of one of the insulated conductors 12 of a conductor pair 20, and the width of the grooves accommodates the width of both the straight and twist portions of the conductor pairs 20.

The upper roller 36 is preferably made of hard rubber, or with a hard rubber facing, and as the outer plastic films 22, 24 and the conductor pairs 20, pass between the laminating rollers 34, 36, the plastic films 22, 24 are continuously laminated to each other at the nip areas 21, and at the side edges 23 of the cable 10, under the pressure applied by the rollers 34, 36, and also under the influence of heat. The plastic films 22, 24 are also preferably laminated to the insulation of the insulated conductors 12 of each conductor pair. The heat source is preferably a supply of hot air, supplied through air nozzles 50 placed closely adjacent the laminating rollers 34, 36, as schematically shown in FIG. 5. The critical bonding temperature for the plastic film employed is well known in the art, for any particular plastic film chosen.

The resulting cable 10 has a plurality of twist and straight conductor pairs 20, precisely oriented and spaced, with respect to each other, by means of the upper and lower laminated plastic films 22, 24. The upper and lower plastic films 22, 24, once laminated, can be described as forming, an alignment means comprising a bonded laminate, or unitary plastic film having a plurality of spaced encapsulating ducts 27, each of the ducts containing at least one of said insulated conductor pairs and preventing untwisting of each of the insulated conductor pairs contained therein, the bonded laminate also having nip areas 21 extending laterally between, and joining each of said spaced encapsulating ducts.

It has been previously mentioned that the twist rotation between immediately adjacent twisted portions of pairs 20 are counter to each other. If a conductor pair 20 lay relatively loosely within the plastic films 22, 24, it is possible that some untwisting of the twisted portions could take place. For this reason, it is presently preferred, as mentioned earlier, to have the plastic films 22, 24 bonded to the insulation 14 of the conductors 13, as well as bonded at the nip areas 21 and side edges 23 of the cable 10, in order to firmly anchor the cable and prevent it from untwisting.

The conductor pair 20 may also be firmly anchored, mechanically, by drawing the plastic films 22, 24 tightly over each conductor pair 20. In this case, the plastic films 22, 24 need not be bonded to insulation 14 of the conductors 12. The insulation 14 of the conductors 12 can be made non-adherent to the plastic film by any one of a number of methods well known in the prior art. For example, if a small percentage of silicone is incorporated into the pvc conductor insulation, the pvc plastic films 22, 24 will not adhere to the insulation so that only the films 22, 24 will be bonded to each other along the nip areas 21 and edges 23.

An alternative form of cable of this invention designated by the numeral 100, is shown in FIG. 7. Cable 100 comprises a plurality of twist and straight conductor pairs 20, as hereinbefore described with reference to FIGS. 1–4 encapsulated between plastic films 22 and 24. However, in cable 100, the plastic films 22, 24 are only intermittently bonded to each other along the nip areas. The bonded nip areas are indicated by the numeral 121 and the unbonded nip areas by the numeral 121*a*. The plastic films are bonded, intermittently, to the insulation of the conductor pairs, as indicated by numeral 125, the unbonded areas being indicated by 125*a*. The bonding of the plastic films to the insulation of the conductors at 125 and the bonding of the plastic films to each other in the nip areas at 121 are in a pattern of lateral alignment.

The side edges 123 of the cable 100 are preferably continuously bonded, as shown in FIG. 7, but may also be intermittently bonded in the same, or different intermittent pattern as shown for the nip areas 121, 121*a* and for the intermittently bonded plastic films.

The intermittent bonding pattern of cable 100 is such that one or more unbonded areas 121*a* preferably coincide with a part or all of a straight portion A of a conductor pair 20.

The conductors 12 of cable 100, just described, are thereby easily separated, for termination purposes. The plastic film 22 or 24, of the intermittent bonded cable 100 is readily peeled back to the point in the unbonded areas 121*a*, 125*a*, where it is desired to be terminated. This point will usually coincide with a straight portion of the twist and straight conductor pair. The cable 100 is then cut at this point exposing ends immediately free for termination to an IDC, or to another interconnection means, without any untwisting.

The intermittent bonding of the plastic films in cable 100, is effected simply by means of laminating rollers shown schematically in FIG. 6. The lower and upper plastic films, encapsulating the conductor pairs, pass between laminating rollers 34*a*, 36*a* of FIG. 6, wherein upper roller 36*a* is a hard rubber roller substantially the same as roller 36. Roller 34*a*, however, has alternating flat areas 52 and circular areas 54 formed on the entire face thereof except at the outer edges of the roller. At the outer edges 59, the roller 34*a* is entirely circular. As the hot plastic films pass adjacent the flat portions of roller 34*a*, no contact of the two films is made at that instant, and no bonding of the films takes place either in the nip areas 121*a* or in the adjacent conductor areas 125*a*. Conversely, however, as arcuate portions 54 of roller 34*a* abut the lower plastic film, such abutting portions of the hot plastic film will contact the upper hot plastic film, abutting upper roller 36*a*, and adherent contact of the plastic films will be made with the resulting intermittent welding pattern being shown in FIG. 7. The welding pattern along side edges 123 is continuous, however, because the side edges 59 of roller 34 are completely round, and there is thus a continuous contact of the upper and lower plastic films constituting the side edges 123 of cable 100.

It is presently preferred that the edges 123 of cable 100 be continuously welded (e.g., heat bonded) rather than being intermittently welded. When the edges 123 are continuously welded, as shown, the hot air, blowing from a nozzle 150, onto the plastic film, will not escape through the side edges of the cable 100. The thusly entrapped air will more effectively support the upper plastic film, in spaced fashion with respect to the lower plastic film, and thereby positively prevent bonding of the film adjacent the flat areas 52 of roller 34*a* — where film bonding is not desired. Intermittent bonding of the plastic film side edges 123 can also be utilized in combination with intermittent bonding internally thereof.

Other methods of intermittent bonding may also be employed.

It will be understood that the intermittent bonding patterns and spacing and orientation of the conductors may be varied considerably depending only upon configuration of the lower roller. By way of example only, the alternating flat areas may each occupy a 30° segment of a circle. The gage of the wire utilized, the spacing thereof, the degree of rotation, the length of twisted and straight sections, can all be varied by those skilled in the art.

Several other variations of the cable 10 or 100 of this invention, are shown in FIGS. 8 and 9. In FIG. 8, there is shown a twist and straight multi-conductor cable 200, the cross-section shown being taken through the twisted portion of the cable. Each conductor pair 220 is essentially the same configuration as conductor pair 20. However, in FIG. 8, two double conductor pairs 220 are encapsulated within the nip areas 221 of plastic films 224 and 222 being continuously or intermittently bonded, and the side edges 223 thereof being also continuously or intermittently bonded.

In FIG. 9, a cable 300 is shown comprising another form of multi-conductor twist and straight conductor pairs 320 wherein two double conductor pairs are encapsulated within the nip areas 321, the nip areas 321 being continuously bonded. The nip areas 321 are provided with a tear line 327, the tear line 327 comprising simply a line along each of the nip areas having less plastic than the surrounding portions of each of the nip areas.

Various modifications of the invention herein set forth will become apparent to those skilled in the art. Therefore, I do not intend to be limited by the forms of the invention herein shown and described but only by the claims which follow.

I claim:

1. A laminated multi-conductor cable, which comprises:

a plurality of laterally spaced, longitudinally extending, insulated wire conductor pairs, each of said longitudinally extending insulated conductor pairs having alternating twisted portions and straight portions;

a first laminating plastic film completely underlying said spaced insulated conductor pairs; and a second laminating plastic film completely overlying said spaced insulated conductor pairs and being laminated to said first plastic film at least at nip areas extending laterally between said alternating twisted portions and straight portions of each of said spaced conductor insulated pairs, said first and second laminated films tightly surrounding each of said alternating twisted portions and straight portions of each of said spaced insulated conductor pairs and forming longitudinally extending encapsulating ducts for said alternating twisted portions and said straight portions of each of said spaced insulated conductor pairs to thereby precisely space each of said spaced conductor pairs along their entire lengths within said laminated cable.

2. The multi-conductor cable of claim 1 wherein said encapsulating ducts are at least partially bonded to the insulation of said spaced insulated conductor pairs.

3. The mult-conductor cable of claim 1 wherein said encapsulating ducts are substantially entirely bonded to the insulation of said spaced insulated conductor pairs.

4. The multi-conductor cable of claim 1 wherein said encapsulating ducts are intermittently bonded to the insulation of said spaced insulated conductor pairs.

5. The multi-conductor cable of claim 1 wherein said encapsulating ducts are substantially free of the insulation of said spaced insulated conductor pairs.

6. The multi-conductor cable of claim 1 wherein said first and second plastic films constituting said nip areas are continuously bonded to each other to form a unitary plastic film.

7. The multi-conductor cable of claim 1 wherein said first and second plastic films constituting said nip areas are intermittently bonded to each other.

8. The multi-conductor cable of claim 1 wherein said encapsulating ducts are intermittently bonded to the insulation of said spaced insulated conductor pairs, and said first and second plastic films constituting said nip areas are intermittently bonded together, the bonded areas of said encapsulating ducts and the bonded areas of said nip areas being in substantially lateral alignment.

9. The multi-conductor cable of claim 1 wherein those portions of said first and second plastic films comprising those portions of said outer side edges of said cable are continuously bonded.

10. The multi-conductor cable of claim 1 wherein those positions of said first and second plastic films comprising the outer side edges of said cable are intermittently bonded.

11. The laminated multi-conductor cable of claim 1 wherein the straight portions of the cables are at least one-quarter of 1 inch in length.

* * * * *